US006060944A

United States Patent [19]

Casper

[11] Patent Number: 6,060,944

[45] **Date of Patent: *May 9, 2000**

[54] N-CHANNEL VOLTAGE REGULATOR

[75] Inventor: Stephen L. Casper, Boise, Id.

[73] Assignee: Micron Technology, Inc., Boise, Id.

[ * ] Notice: This patent issued on a continued prosecution application filed under 37 CFR 1.53(d), and is subject to the twenty year patent term provisions of 35 U.S.C. 154(a)(2).

[21] Appl. No.: 08/911,330

[22] Filed: Aug. 14, 1997

[51] Int. Cl.[7] ..... G05F 1/10

[52] U.S. Cl. ..... 327/541; 327/543; 323/313; 323/315

[58] Field of Search ..... 327/538, 540, 327/541, 543, 546; 323/313, 315

[56] References Cited

U.S. PATENT DOCUMENTS

| | | | |
|---|---|---|---|
| 4,771,228 | 9/1988 | Hestor et al. | 323/315 |
| 5,008,586 | 4/1991 | Miyazaki et al. | 323/315 |
| 5,187,429 | 2/1993 | Phillips | 323/314 |
| 5,373,477 | 12/1994 | Sugibayashi | 327/541 |
| 5,563,504 | 10/1996 | Gilbert et al. | 323/316 |
| 5,594,326 | 1/1997 | Gilbert | 323/313 |
| 5,629,613 | 5/1997 | Marzolf et al. | 323/315 |
| 5,703,477 | 12/1997 | Punzenberger | 323/313 |

*Primary Examiner*—Terry D. Cunningham
*Attorney, Agent, or Firm*—Schwegman, Lundberg, Woessner & Kluth, P.A.

[57] ABSTRACT

A voltage regulator circuit for regulating an input voltage supply. The voltage regulator includes a first n-channel transistor. The first n-channel transistor includes a gate and a source/drain region that provides an output for the regulator circuit. The voltage regulator also includes a second n-channel transistor. The second n-channel transistor includes a gate that is coupled to the gate of the first n-channel transistor and further includes a first source/drain region that is coupled to the source/drain region of the first n-channel transistor. The first n-channel transistor is sized so as to provide lower drive current than the second n-channel transistor. The voltage regulator also includes a selector circuit that is coupled to a second source/drain region of the second n-channel transistor that selectively decouples the second n-channel transistor from the output of the voltage regulator circuit based on a state of the functional circuit.

23 Claims, 2 Drawing Sheets

N-CHANNEL VOLTAGE REGULATOR

TECHNICAL FIELD OF THE INVENTION

The present invention relates generally to the field of electronic circuits and, in particular, to an n-channel voltage regulator.

BACKGROUND OF THE INVENTION

A semiconductor circuit or logic device may be designed for any of a wide variety of applications. Typically, the device includes logic circuitry to receive, manipulate or store input data, and the same or modified data is subsequently generated at an output terminal of the device. Depending on the type of logic device or the circuit environment in which the device is used, the device may include a regulator that provides an internal power signal that is independent of fluctuations of an external power signal.

A dynamic random access memory (DRAM), formed as an integrated circuit, is an example of such a semiconductor circuit or logic device having a regulator. Conventionally, the DRAM receives an external power signal ($V_{CCX}$) having a voltage intended to maintain a voltage level (or range), for example, of 5 volts measured relative to common or ground. Internal to the DRAM, the regulator maintains an internal power signal ($V_{CCR}$) at a designated level, for example, of 3.3 volts. Ideally, $V_{CCR}$ linearly tracks $V_{CCX}$ from zero volts to the designated level at which point $V_{CCR}$ remains constant as $V_{CCX}$ continues to increase in voltage or fluctuate above this level.

A number of previously implemented semiconductor power regulation circuits use a feedback-controlled p-channel transistor at the output of a control circuit, wherein the p-channel transistor is modulated once $V_{CCX}$ reaches the internal operating voltage level, at which point $V_{CCR}$ remains constant as described above. This approach is disadvantageous, however, because the feedback-controlled p-channel transistor acts in a manner similar to an operational amplifier whereby a substantial amount of current may be consumed during normal operation.

One known approach for mitigating this problem is to implement the control circuit at the input of the p-channel transistor with a low-power standby mode. In this mode, the larger p-channel transistor is deactivated when the integrated circuit is not in use so as to limit the excessive drain of drive current by the feedback-controlled p-channel transistor. Despite this limitation on current consumption, it is still desirable to reduce the overall level of current consumption. This is especially true for integrated circuit applications in which the integrated circuit is seldom not in use, in which case the beneficial contribution of the standby mode is nominal at best. Moreover, the standby approach introduces a delay to the operation of the integrated circuit, for example, during the transition from standby to normal operation. For fast-responding integrated circuits, such an additional delay is undesirable and often unacceptable.

U.S. Pat. No. 5,552,740 (the Casper patent) issued to Stephen L. Casper on Sep. 3, 1996 and is assigned to Micron Technology, Inc. The Casper patent describes an alternative to the more conventional feedback-controlled p-channel transistor-based regulator. Specifically, Casper describes a power-efficient power regulation circuit for use in semiconductor circuits powered by a power signal. The power regulation circuit includes an n-channel transistor which provides a regulated power signal having a stabilized voltage level for use by the semiconductor circuit. A bias pull-up circuit is coupled to the gate of the n-channel transistor and arranged for biasing the n-channel transistor so that it normally conducts current. A resistive circuit, including a resistive element arranged in series with a resistor-arranged p-channel transistor, is coupled to a source of the n-channel transistor and, in response to the regulated power signal, provides a feedback-control signal. A voltage control circuit, coupled to the bias pull-up circuit and the resistive circuit, is activated to control the n-channel transistor in response to the feedback control signal so as to provide the regulated output voltage. Unfortunately, the n-channel transistor may fluctuate by up to 200 or 300 millivolts when the circuit it drives switches between standby and active modes.

For the reasons stated above, and for other reasons stated below which will become apparent to those skilled in the art upon reading and understanding the present specification, there is a need in the art for a regulator circuit that provides improved regulation during transitions between active and standby operation of the circuit that is powered by the regulator circuit.

SUMMARY OF THE INVENTION

The above mentioned problems with power regulators and other problems are addressed by the present invention which will be understood by reading and studying the following specification. An n-channel regulator is described which uses two n-channel transistors at the output of the regulator to reduce fluctuations in the output of the regulator when the circuit driven by the regulator switches between active and standby modes.

In particular, an illustrative embodiment of the present invention includes a voltage regulator circuit for regulating an input voltage for a functional circuit. The voltage regulator circuit includes a first n-channel transistor with a control gate and an output for the regulator. The voltage regulator circuit also includes a second n-channel transistor with a gate coupled to the gate of the first n-channel transistor and an output coupled to the output of the first n-channel transistor. The first n-channel transistor is sized so as to provide lower drive current than the second n-channel transistor. The voltage regulator circuit also includes a selector circuit that is coupled to the second n-channel transistor. The selector circuit selectively decouples the second n-channel transistor from the output of the first n-channel transistor based on a state of the functional circuit.

In another embodiment, an electronic system is provided. The electronic system includes microprocessor that generates control signals. A functional circuit is also included that is coupled to the microprocessor. The electronic system also includes a voltage regulation circuit that is responsive to the control signals of the microprocessor as well as the functional circuit. The voltage regulation circuit receives an unregulated input voltage and provides a regulated output voltage to the functional circuit. The voltage regulation circuit also includes first and second n-channel transistors that are coupled to provide the output voltage to the functional circuit. The voltage regulation circuit includes a selector circuit that selectively decouples the second n-channel transistor from the output of the voltage regulation circuit based on the state of the functional circuit.

In another embodiment, the method for regulating a voltage for an integrated circuit with an n-channel regulator is provided. The method determines the state of operation of the integrated circuit. Additionally, the method selectively couples an n-channel transistor to the output of the n-channel regulator during a first operating state of the integrated circuit. This reduces fluctuation in the output of the regulator due to differences in drive current used by the integrated circuit during different operating states.

In another embodiment, a voltage regulator for a functional circuit is provided. A voltage regulator includes a variable drive output device. Further, the voltage regulator includes pull-up and pull-down circuits that are coupled to a control input of the variable drive output device. The voltage regulator also includes a level sensing circuit that is responsive to the voltage level of the output device. The level sensing circuit is coupled to a control input of the pull-down device. A selector circuit sets the drive of the variable drive output device based on a state of functional circuit.

In another embodiment, a voltage regulator circuit for regulating an input voltage for a functional circuit is provided. The voltage regulator includes a first n-channel transistor having a gate and having a source/drain region that provides an output for the regulator circuit. The voltage regulator circuit further includes a second n-channel transistor with a gate that is coupled to the gate of the first n-channel transistor. The second n-channel transistor also includes a first source/drain region that is coupled to the source/drain region of the first n-channel transistor. The first n-channel transistor is sized so as to provide lower drive current than the second n-channel transistor. Finally, the voltage regulator circuit includes a selector circuit. The selector circuit is coupled to a second source/drain region of the second n-channel transistor that selectively decouples the second n-channel transistor from the output of the voltage regulator circuit based on a state of the functional circuit.

DETAILED DESCRIPTION OF THE INVENTION

In the following detailed description, reference is made to the accompanying drawings which form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense.

Figure 1:
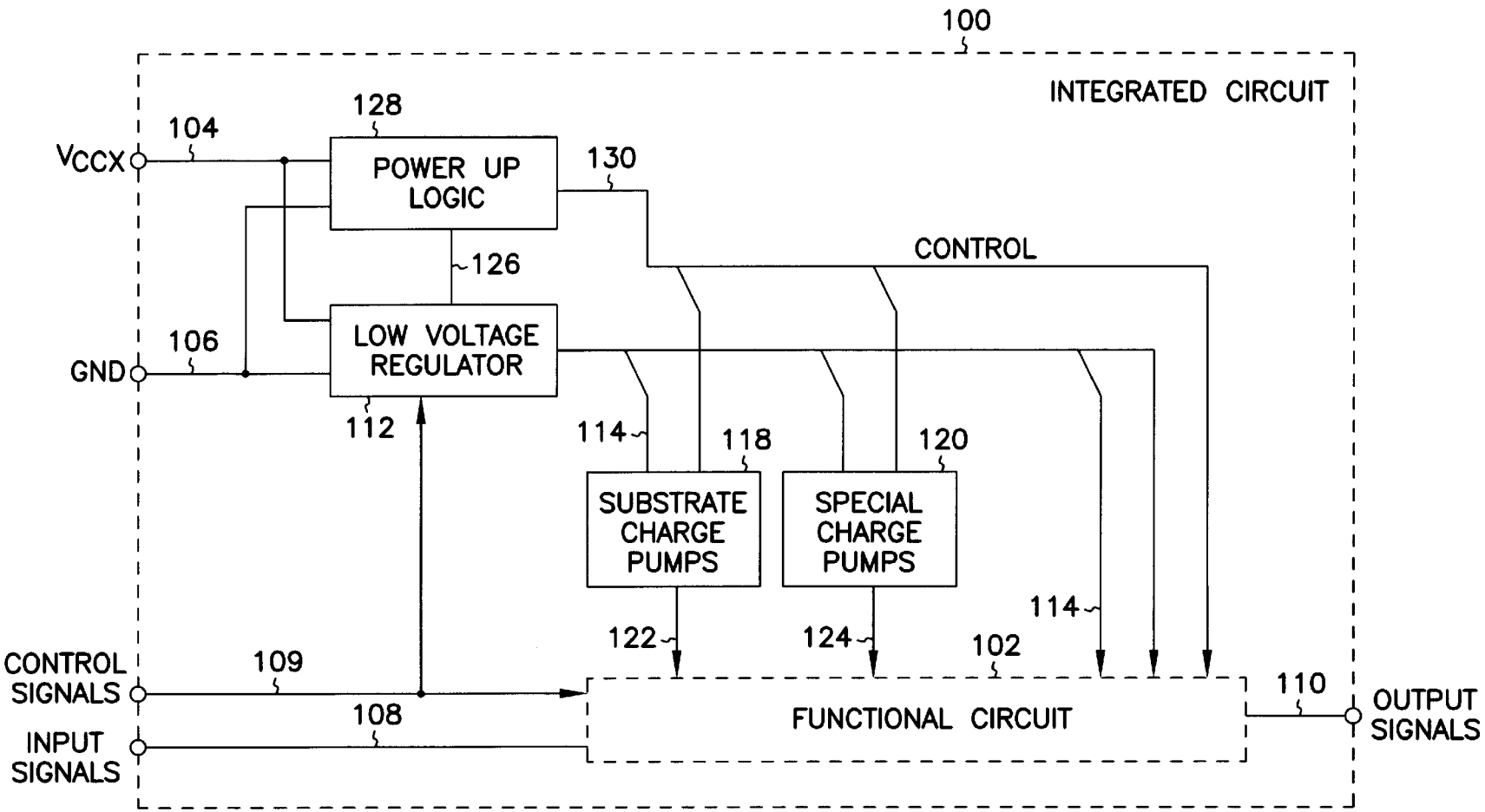
FIG. 1 is a block diagram of an embodiment of an integrated circuit according to the teachings of the present invention.

FIG. 1 is a block diagram that represents an integrated circuit, indicated generally at 100, including a low voltage regulator constructed according to the teachings of the present invention. Integrated circuit 100 includes conventional electrical circuit functions shown generally as functional circuit 102, connections for power signals 104 ($V_{CCX}$), ground conductor 106 (GND), an input shown generally as input signals 108, an optional output shown generally as output signals 110 and control signals shown generally as control signals 109. As shown, functional circuit 102 uses power and control signals for initialization and operation.

Integrated circuit 100 provides regulated power signals for functional circuit 102 using power signals 104. Voltages of power signals, for example, $V_{CCX}$, are conventionally measured relative to a reference signal, for example, ground. Low voltage regulator 112 provides power signals 114, coupled to functional circuit 102, and coupled as required to substrate charge pumps 118 and special charge pumps 120. Substrate charge pumps 118 and special charge pumps 120, which are conventional, respectively provide power signals 122 and 124, which are coupled to functional circuit 102.

Low voltage regulator 112 receives power and control signals 126 provided by power-up logic 128. Further, low voltage regulator 112 receives one or more control signals 109 which indicate when functional circuit 102 switches between active and standby operation. It is noted that other signals, e.g., signals from functional circuit 102, could also be used to differentiate active and standby modes of operation. Low voltage regulator 112 may also regulate elevated voltages or current. Control signals 126 enable and govern the operation of low voltage regulator 112. Similarly, control signals 130, provided by power-up logic 128, enable and govern the operation of substrate charge pumps 118 and special charge pumps 120. The sequence of enablement of these several functional blocks depends on the circuitry of each functional block and upon the power of signal sequence requirements of functional circuit 102.

Functional circuit 102 performs an electrical function of integrated circuit 100. In various embodiments, functional circuit 102 is an analog circuit, a digital circuit, or a combination of analog and digital circuitry. Although embodiments of the present invention are effectively applied where functional circuit 102 includes a dynamic random access memory (DRAM), a static random access memory (SRAM), or a video random access memory (VRAM) having a serial port, the teachings of the present invention can be advantageously applied to a number of other integrated circuits requiring an internal power voltage regulator.

The conventional dynamic random access memory includes an array of storage cells. In embodiments of the present invention, accessing the array for read, write, or refresh operations is accomplished with circuitry powered by voltages having magnitudes that may be different from the voltage magnitude of signal $V_{CCX}$. These additional voltages are developed from voltage regulator 112.

Power to be applied to functional circuit 102 is conventionally regulated to permit use of integrated circuit 100 in systems providing power that, otherwise, would be insufficiently regulated for proper operation of functional circuit 102. Low voltage regulator 112 includes a voltage reference and regulator circuit (not shown) having sufficient regulated output to supply signal $V_{CCR}$, part of power signals 114.

Figure 2:
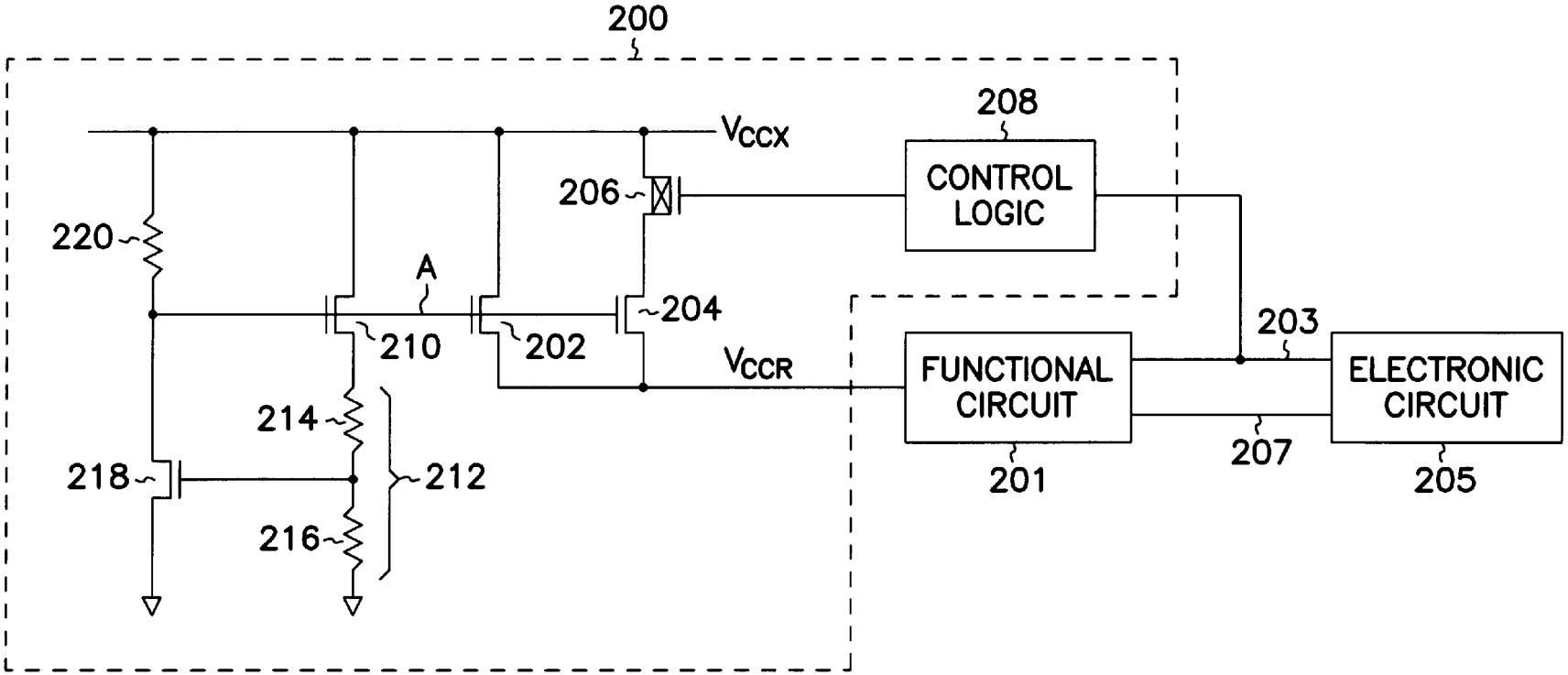
FIG. 2 is a schematic diagram of an embodiment of a voltage regulator according to the teachings of the present invention.

FIG. 2 is a schematic diagram of an embodiment of a voltage regulator circuit, indicated generally at 200, and constructed according to the teachings of the present invention. Regulator 200 includes first and second n-channel output transistors 202 and 204. A gate of transistor 202 is coupled to a gate of transistor 204 at a node A. Additionally, a first source/drain region of transistor 202 is coupled to a first source/drain region of transistor 204 to provide the output of regulator 200, labeled $V_{CCR}$ in FIG. 2. This voltage signal is supplied to functional circuit 201. A second source/drain region of transistor 202 is coupled to external power supply $V_{CCX}$.

Regulator 200 further includes p-channel transistor 206 and control logic 208 that selectively control the current provided by transistor 204 so as to reduce fluctuations in the voltage $V_{CCR}$ when functional circuit 201 transitions between active and standby modes of operation. Transistor 206 includes a first source/drain region that is coupled to a second source/drain region of transistor 204. Additionally, transistor 206 includes a second source/drain region that is coupled to the external power supply $V_{CCX}$. Finally, transistor 206 includes a gate that is coupled to an output of control logic 208.

Control logic 208 is coupled to receive signals that indicate when functional circuit 201 transitions between active and standby modes. In one embodiment, control logic 208 is coupled to receive control signals 203 from electronic circuit 205. Electronic circuit 205 may comprise, for example, a microprocessor, chip set, memory controller, or other appropriate electronic circuit. In one embodiment, control signals 203 may include a row address strobe (RAS) signal for a dynamic random access memory (DRAM) device. When the RAS signal is active, this indicates to control logic 208 that functional circuit 201 is in active mode. When RAS goes inactive, this indicates that functional circuit 201 is in standby mode. Other signals can be used to differentiate between standby and active operation of functional circuit 201. Electronic circuit 205 is also coupled to functional circuit 201 over input/output lines 207.

Transistors 202 and 204 are sized so as to provide appropriate drive current during active and standby modes. Typically, transistor 204 will be on the order of 5 to 10 times larger than transistor 202. For example, when regulator 200 uses only the row address strobe (RAS) signal of a DRAM device to differentiate between active and standby operation of functional circuit 201, a ratio of 4:1 or 5:1 can be used for transistors 204 and 202. When the operation of charge pumps of the DRAM is also used to differentiate between active and standby operation, the ratio of the widths of transistors 204 and 202 may be on the order of 10:1.

Regulator 200 further includes n-channel transistor 210, transistor 210 includes a gate that is coupled to Node A and a first source/drain region that is coupled to external voltage supply $V_{CCX}$. Regulator 200 further includes voltage divider 212 that is coupled between a second source/drain region of transistor 210 and ground potential so as to perform a level sensing function. An output of voltage divider 212 is coupled to a gate of transistor 218. Transistor 218 also includes a first source/drain region that is coupled to ground and a second source/drain region that is coupled to node A. Finally, regulator 200 includes resistor 220 that is coupled between $V_{CCX}$ and node A.

In operation, regulator 200 provides a regulated output voltage labeled $V_{CCR}$ with reduced fluctuation during the transition between active or standby modes of functional circuit 201. Control logic 208 receives control signals that indicate when functional circuit 201 enters active mode. In response, control logic 208 produces a low logic output that turns on transistor 206. This, in turn, turns on transistor 204. Thus, when functional circuit 201 enters active mode, transistors 202 and 204 provide drive current for functional circuit 201. By increasing the drive current capability of regulator 200 during this transition, the output of regulator 200 is maintained at a substantially constant voltage.

Similarly, during transition to standby mode, control logic 208 turns off transistor 206. Transistor 204 is turned off so as to reduce the drive current capability of regulator 200 during standby operation.

CONCLUSION

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention. For example, the sizing transistors 202 and 204 can be varied based on the needs of a specific implementation. Further, the type of level sensing and feedback control for the n-channel regulator can be varied from the specific embodiment shown in FIG. 2. A regulator circuit constructed according to the teachings of the present invention can also be used with circuits other than memory devices.

What is claimed is:

1. A voltage regulator circuit for regulating an input voltage for a functional circuit, comprising:

a first n-channel transistor having a control gate, a drain coupled to the input voltage and a source that provides an output for the regulator;

a second n-channel transistor having a gate coupled to the gate of the first n-channel transistor, a drain, and a source that is coupled to the source of the first n-channel transistor;

a bias voltage generation circuit coupled to the control gates of the first and second transistors;

wherein the first n-channel transistor is sized so as to provide lower drive current than the second n-channel transistor; and a selector circuit coupled to the drain of the second n-channel transistor that selectively causes the second n-channel transistor to provide either a drive current or substantially no drive current to the output for the regulator based on a signal that is provided to and sets a state of the functional circuit.

2. The voltage regulator circuit of claim 1, wherein the selector circuit includes a p-channel transistor coupled to the drain of the second n-channel transistor such that when the p-channel transistor is turned off, the second n-channel transistor provides substantially no drive current for the functional circuit.

3. The voltage regulator circuit of claim 2, wherein the selector circuit further comprises a control logic circuit coupled to a gate of the p-channel transistor, and wherein the control logic circuit receives the signal that sets the state of the functional circuit.

4. The voltage regulator circuit of claim 3, wherein the functional circuit comprises a dynamic random access memory and the signal is a row address strobe signal for the dynamic random access memory.

5. The voltage regulator circuit of claim 1, wherein the selector circuit is coupled between the drain of the second n-channel transistor and the input voltage.

6. The voltage regulator circuit of claim 1, wherein the width of the first n-channel transistor is smaller than the width of the second n-channel transistor.

7. The regulator of claim 1, wherein the selector circuit comprises:

a p-channel transistor with a source coupled to a drain of the second n-channel transistor;

a control logic circuit with an input that is coupled to receive the signal that sets a state of operation of the functional circuit; and an output of the control logic circuit is coupled to a gate of the p-channel transistor so as to turn off the p-channel transistor when the functional circuit is in standby mode.

8. The electronic system of claim 7, wherein the functional circuit comprises a dynamic random access memory and the electronic circuit comprises a microprocessor.

9. The regulator circuit of claim 1, wherein the width of the first n-channel transistor is smaller than the width of the second n-channel transistor.

10. An electronic system, comprising:

an electronic circuit that generates control signals;

a functional circuit that is coupled to the electronic circuit; and a voltage regulation circuit responsive to the control signals and coupled to the functional circuit that receives an unregulated input voltage and provides a regulated output voltage to the functional circuit, the voltage regulation circuit including:

a first n-channel transistor having a control gate, a drain coupled to the input voltage and a source that provides an output for the regulator;

a second n-channel transistor having a gate coupled to the gate of the first n-channel transistor, a drain, and a source that is coupled to the source of the first n-channel transistor;

a bias voltage generation circuit coupled to the control gates of the first and second transistors; and a selector circuit coupled to the drain of the second n-channel transistor that selectively causes the second n-channel transistor to provide substantially no drive current for the functional circuit based on one of said control signals that sets a state of the functional circuit.

11. The electronic system of claim 10, wherein the functional circuit comprises a dynamic random access memory and the electronic circuit comprises a microprocessor.

12. The electronic system of claim 10, wherein the selector circuit includes a p-channel transistor with a drain that is coupled to the source of the second n-channel transistor so as to cause the second n-channel transistor to provide substantially no drive current when the functional circuit is in a standby mode.

13. The electronic system of claim 11, wherein the selector circuit includes a p-channel transistor with a drain that is coupled to the source of the second n-channel transistor so as to cause the second n-channel transistor to provide substantially no drive current when the functional circuit is in a standby mode based on the control signal which is a row address strobe signal from the electronic circuit.

14. The electronic system of claim 10, wherein the selector circuit is coupled to a signal from the electronic circuit that indicates the state of a charge pump of the functional circuit.

15. A method for regulating a voltage for an integrated circuit with an n-channel regulator, the method comprising:

biasing the n-channel regulator with a bias voltage generation circuit;

selecting operation of the integrated circuit to be in a first operating state or a second different operating state; and controlling the n-channel regulator to provide a first current level to an output of the n-channel regulator during the first operating state of the integrated circuit and a second, different current level to an output of the n-channel regulator during the second, different operating state of the integrated circuit to reduce fluctuations in the output of the n-channel regulator due to differences in drive current used by the integrated circuit during different operating states.

16. The method of claim 15, wherein the first state and the second state corresponds to an active mode and a standby mode, respectively.

17. The method of claim 15, wherein controlling the n-channel regulator comprises:

receiving a signal provided to the integrated circuit that sets the state of the circuit;

generating a control signal based on the signal provided to the integrated circuit; and driving a p-channel transistor in a current path for the output of the n-channel regulator with the control signal so as to reduce the output current of the n-channel regulator.

18. The method of claim 16, wherein controlling the n-channel regulator comprises monitoring a control signal provided to the integrated circuit.

19. The method of claim 18, wherein the control signal comprises a row address strobe signal.

20. A voltage regulator for a functional circuit, comprising:

a variable drive output device;

a bias voltage generation circuit coupled to a control input of the variable drive output device to provided a bias thereto; and a selector circuit that sets the drive current of the variable drive output device based on a control signal provided to and determining the state of the functional circuit.

21. The voltage regulator of claim 20, wherein the variable drive output device comprises:

a first n-channel transistor having a gate, a drain coupled to an input voltage, and a source that provides an output for the voltage regulator;

a second n-channel transistor having a gate coupled to the gate of the first n-channel transistor, a drain coupled to the selector, and a source coupled to the source of the first n-channel transistor; and wherein the first n-channel transistor is sized so as to provide lower drive current than the second n-channel transistor.

22. The voltage regulator of claim 17, wherein the variable drive output device comprises a pair of n-channel transistors having different widths.

23. The voltage regulator of claim 20, wherein the variable drive output device is coupled to receive a control signal that selects the state of the functional circuit.

* * * * *

UNITED STATES PATENT AND TRADEMARK OFFICE

CERTIFICATE OF CORRECTION

PATENT NO. : 6,060,944
DATED : May 9, 2000
INVENTOR(S) : Casper

It is certified that error appears in the above-identified patent and that said Letters Patent is hereby corrected as shown below:

Column 8, claim 22,
Delete "claim 17" and insert -- claim 20 --, therefor.

Column 6, claim 8,
Delete "The electronic system of claim 7, wherein the functional circuit comprises a dynamic random access memory and the electronic circuit comprises a microprocessor." and insert -- The regulator circuit of claim 1, wherein the width of the second transistor is on the order of 10 times larger than the width of the first transistor. --, therefor.

Signed and Sealed this

Ninth Day of October, 2001

*Attest:*

Nicholas P. Godici

*Attesting Officer*

NICHOLAS P. GODICI
*Acting Director of the United States Patent and Trademark Office*